United States Patent [19]

Lombardi

[11] Patent Number: 4,652,074

[45] Date of Patent: Mar. 24, 1987

[54] CO-AXIAL ISOLATED GROUND BULKHEAD RECEPTACLE

[75] Inventor: Anthony Lombardi, Boylston, Mass.

[73] Assignee: Kings Electronics Co., Inc., New York, N.Y.

[21] Appl. No.: 730,099

[22] Filed: May 3, 1985

[51] Int. Cl.[4] ..... H01R 17/18

[52] U.S. Cl. ..... 339/177 R; 339/142; 339/206 R; 339/126 J

[58] Field of Search ..... 339/177 R, 177 E, 136–142, 339/49 B, 218 R, 218 M

[56] References Cited

U.S. PATENT DOCUMENTS

| | | | |
|---|---|---|---|
| 3,124,406 | 3/1964 | Cook | 339/177 R |
| 3,381,260 | 4/1968 | Brown | 339/218 M |
| 3,384,859 | 5/1968 | Loose | 339/177 R |
| 3,678,444 | 7/1972 | Stevens et al. | 339/177 R |
| 3,936,132 | 2/1976 | Hutter | 339/177 R |
| 3,994,552 | 11/1976 | Selvin | 339/49 B |

*Primary Examiner*—Gil Weidenfeld
*Assistant Examiner*—David L. Pirlot
*Attorney, Agent, or Firm*—Jordan B. Bierman

[57] ABSTRACT

A co-axial, isolated ground bulkhead receptacle has a metal connector body, a threaded metal mounting body, and an insulator body having a connector end and a mounting end, a central recess for holding a center electrical contact, and a radially located slot for holding an isolated ground contact. In a preferred embodiment, the insulator body has three annular rings at its midsection for securing the respective annular flange ends of the connector body and the mounting body and for maintaining them in electrical isolation from each other. The slot in the insulator body and the ground contact have a curvilinear cross-sectional shape so that the ground contact can be mounted with a constant spacing apart from the metal mounting body.

6 Claims, 2 Drawing Figures

CO-AXIAL ISOLATED GROUND BULKHEAD RECEPTACLE

TECHNICAL FIELD

The invention relates to a bulkhead receptacle for electrical connectors and, particularly, to a receptacle of the co-axial BNC series type.

BACKGROUND ART

Bulkhead receptacles of the co-axial BNC series type typically have one end mounted to an opening in an equipment chassis and the other end configured to receive a BNC type male connector for co-axial cable having a bayonnet slot which locks onto a studded outer connector body of the receptacle. The studded connector body of the receptacle forms the connector ground contact, and an insulated center female contact receives the center male contact of the connector. Known forms of such receiptacles typically have a metal body for mounting the receptable to and forming a ground contact with the equipment chassis.

However, in some situation, it is desirable to have the ground contact insulated from the chassis, for example, to form an internal ground contact which is isolated from electromagnetic interference picked up by the chassis. This is known as an isolated RF ground. In one conventional form of isolated ground receptacle, the mounting body is made of an insulator material, such as plastic, with threading for mounting the receptacle to the equipment chassis with a nut and lock washer. However, the plastic insulator body can be deformed or worn down under the pressure of torque applied during mounting to the chassis or when connectors are locked onto the receptacle. The deformation or wear can result in shorting or loss of a good electrical contact.

SUMMARY OF THE INVENTION

It is therefore a principal object of the invention to provide a co-axial, isolated ground bulkhead receptacle which has a mounting end of high strength and durability and can maintain a proper isolation of the ground contact from the chassis and the center contact, as well as a good electrical connection through the receptacle to the connector ground. It is a further object of the invention to provide a receptacle which can be conveniently manufactured and assembled, and which minimizes the possibility of shorting or loss of good electrical contact.

In accordance with the invention, a co-axial, isolated ground bulkhead receptacle has a metal outer connector body, a threaded metal mounting body, an insulator body having a connector end and a mounting end, a central recess for holding a center electrical contact, and a radially located slot for holding an isolated ground contact to form an electrical connection with the connector body and to extend from the insulator body at the mounting end. In a preferred embodiment, the insulator body has three annular rings at its midsection for securing the respective annular flange ends of the connector and mounting bodies and for maintaining them in electrical isolation from each other. The slot in the insulator body and the ground contact have a curvilinear cross-sectional shape so that the ground contact can be mounted with a constant spacing apart from the metal mounting body. Further, the insulator body has splines on its surfaces assembled in contact with the connector body and the mounting body to provide a high resistance to turning under an applied torque.

DETAILED DESCRIPTION OF THE DRAWINGS

Figure 1:
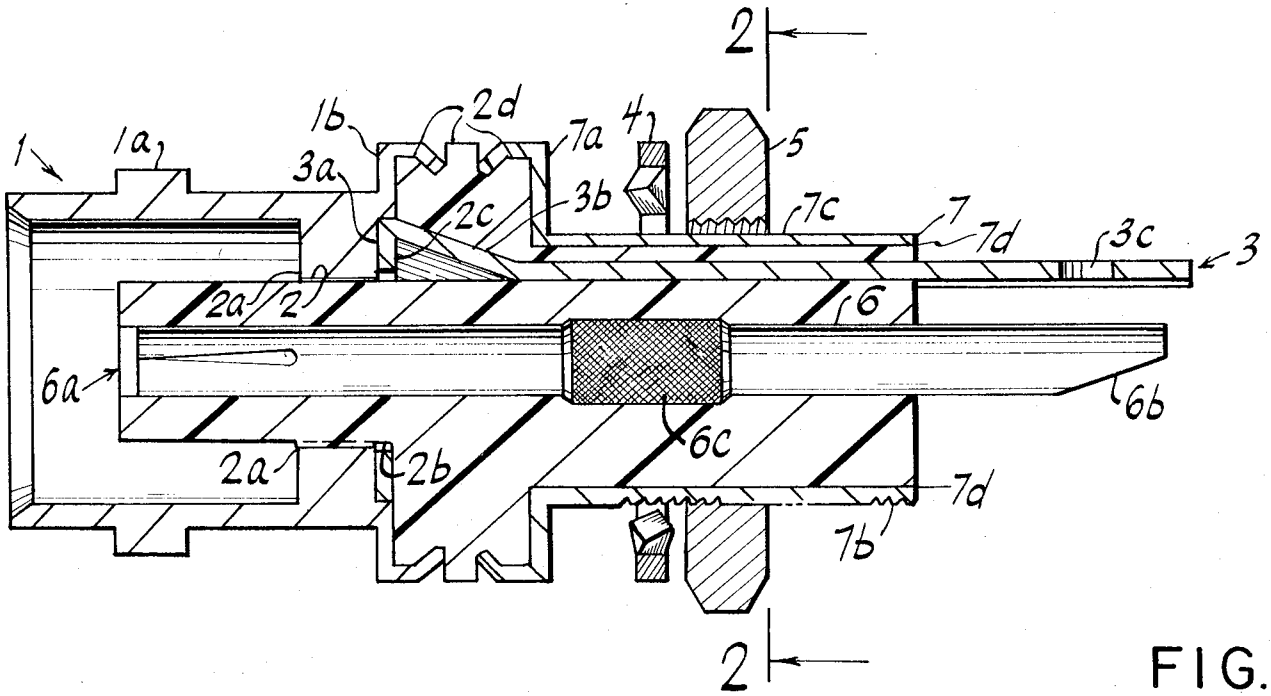
Figure 2:
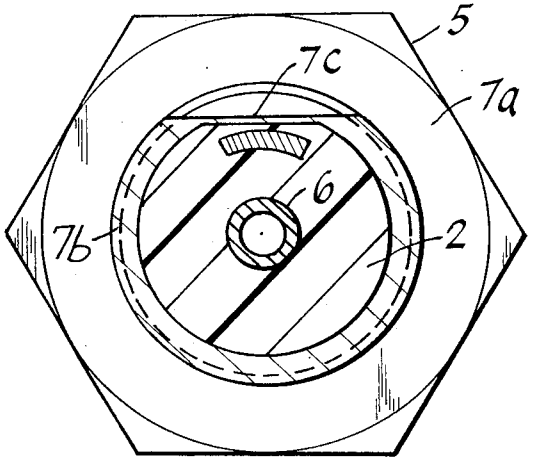

The above objects and further features and advantages of the invention are described in detail below in conjunction with the drawings, of which:

FIG. 1 is a side sectional view of a co-axial isolated ground bulkhead-receptacle in accordance with the invention; and FIG. 2 is a front sectional view of the receptacle of FIG. 1 taken along view line A—A.

DETAILED DESCRIPTION OF THE PREFERRED EMBODIMENTS

The following is a detailed description of one preferred form of the invention embodied as a co-axial isolated ground bulkhead receptacle of the female BNC series type. However, it will be understood that the principles of the invention can be equally applied to other forms of co-axial receptacles or electrical connectors.

Referring to FIG. 1, metal connctor body 1 has a central opening for receiving a connector for a co-axial cable, and studs 1*a* which are mated in bayonnet slots formed in the connector (not shown) for securely locking the connector to metal connector body 1. Female contact 6 has slotted end 6*a* for receiving a center male contact (not shown) of the connector, and is isolated from metal connector body 1 by insulator body 2. Insulator body 2 has a splined surface 2*a* which is press-fitted against corresponding splines or corrugations on the inner surface of metal connector body 1, so as to secure them fixedly together and prevent turning of the bodies relative to each other under an applied torque, such as when the bayonnet connector is mounted to connector body 1.

Insulator body 2 has shoulder portion 2*b* and a slot, generally indicated at 2*c*, for mounting isolated ground lug 3. Ground lug 3 has annular ring 3*a* which fits over the connector end of insulator body 2 (left side of FIG. 1) and is located in position against shoulder portion 2*b*. During assembly, metal connector body 1 is press-fitted over the connector end of insulator body 2 and presses ground lug 3 against shoulder portion 2*b* so as to form a good electrical contact therewith. Slot 2*c* has a tapered wall and ground lug 3 has a corresponding tapered section 3*b* which are pressed together during assembly. The pressing of the tapered walls results in a spring force applied by ground lug 3 against connector body 1 to form a good electrical contact therewith.

At about its midsection, insulator body 2 has three annular rings 2*d* separated by grooves. One outside ring is used for securing annular flange end 1*b* of connector body 1, and the other outside ring for annular flange end 7*a* of metal mounting body 7. The flange ends 1*b* and 7*a* are peened over by a spinning tool into the grooves between rings 2*d*, so as to securely mount the metal connector body 1 and the metal mounting body 7 over the ends of insulator body 2, while the center ring of rings 2*d* maintains them apart in electrical isolation.

Mounting body 7 has threading 7*b* for mounting the receptacle to an equipment chassis (not shown) by means of nut 5 and lock washer 4. Mounting body 7 also has flat section 7*c*, known in the industry as a D-flat, which fits into a correspondingly shaped D-hole in the chassis, so as to prevent the receptacle from rotational movement under an applied torque. As seen more clearly in FIG. 2, mounting body 7 is concentric with respect to female contact 6 and insulator body 2. The end of isolated ground lug 3 extends from insulator body 2 beyond mounting body 7, and has a curved cross-sectional shape so that ground lug 3 is spaced a constant distance from metal mounting body 7, thereby preventing any shorting therebetween such as might occur if a conventional flat shaped ground lug is used. Ground lug 3 has hole 3*c*, and female contact 6 has a cut-away section 6*b* for facilitating a soldered electrical connection with leads in the chassis in a conventional manner.

Female contact 6 has knurled section 6*c* for making a tight, friction contact when female contact 6 is press-fitted into insulator body 2 during assembly. Insulator body 2 and mounting body 7 have splines or ribbing on their respective mating surfaces which is generally indicated at 7*d*, for forming a secure fit and preventing insulator body 2 from rotating under torque pressure.

The invention as illustrated in the described embodiment has the advantages of high mounting strength and durability through the construction of metal mounting body 7, as well as electrical isolation of ground lug 3 from center contact 6 and the metal mounting body 7. It is simple to manufacture and assemble due to the construction of insulator body 2 for secure mounting of connector body 1 and mounting body 7. Insulator rings 2*d* of insulator body 2 provide a convenient and secure mounting for the annular flange ends of the respective metal parts while maintaining them in electrical isolation. Further, ground lug 3 has a novel curved cross-sectional shape to minimize possible shorting from the lug to metal mounting body 7, and has a tapered section for pressing the lug into good electrical contact with connector body 1 upon assembly of the receptacle. The receptacle thus has exceptional strength and durability and provides the proper ground isolation and ensures good electrical contact through the respective parts.

The above-described embodiment is illustrative of the principles of the invention and is not intended to limit the scope of the invention. Various modifications and substitutions of elements, materials, and equivalent parts may be made without departing from the spirit of the invention. All such modifications and variations are intended to be encompassed within the invention as defined in the following claims.

What is claimed is:

1. A co-axial, isolated ground bulkhead receptacle comprising: a metal connector body adapted to receive a corresponding electrical connector; a metal mounting body having external threads for mounting said receptacle to a chassis, an insulator body having a central bore, a radially located slot, and means for securing said connector body and said mounting body thereto in fixed relation and in electrical isolation from each other; a center electrical contact mounted in said central bore of said insulator body; and a radially located ground contact mounted in said slot of said insulator body in electrical contact with said connector body.

2. The bulkhead receptacle of claim 1, wherein said mounting body is concentric with said insulator body and said center electrical contact, and said slot and ground contact have a curvilinear cross-sectional shape concentric with said mounting body.

3. A co-axial, isolated ground bulkhead receptacle comprising: a metal connector body adapted to receive a corresponding electrical connector; a metal mounting body for mounting said receptacle to a chassis, an insulator body having a central bore, a radially located slot, and means for securing said connector body and said mounting body thereto in fixed relation and in electrical isolation from each other; a center electrical contact mounted in said central bore of said insulator body; and a radially located ground contact mounted in said slot of said insulator body in electrical contact with said connector body, said means for securing of said insulator body includes three annular rings formed at a mid-section of said insulator body, said connector body having an annular flange end which fits over one of said rings, said mounting body having an annular flange end which fits over another of said rings, and a middle one of said three rings maintaining said connector body and said mounting body in electrical isolation.

4. The bulkhead receptacle of claim 3, wherein the respective annular flange ends of said connector body and mounting body, are peened over the corresponding rings into grooves formed between said rings.

5. The bulkhead receptacle of claim 4, wherein said slot of said insulator body has a tapered wall at the mid-section thereof, and said ground contact has a tapered section located adjacent said tapered wall, and further wherein said tapered wall is pressed against said tapered section, so as to force said ground contact into good electrical contact with said connector body.

6. A co-axial, isolated ground bulkhead receptacle comprising: a metal connector body adapted to receive a corresponding electrical connector; a metal mounting body for mounting said receptacle to a chassis, an insulator body having a central bore, a radially located slot, and means for securing said connector body and said mounting body thereto in fixed relation and in electrical isolation from each other; a center electrical contact mounted in said central bore of said insulator body; and a radially located ground contact mounted in said slot of said insulator body in electrical contact with said connector body, said connector body, said mounting body, and said insulator body have concentric, cylindrical shapes, said connector body is press-fitted over a connector body end of said insulator body, said mounting body is press-fitted over a mounting end of said insulator body, and said connector body, mounting body and insulator body having splined mating surfaces for forming a secure mechanical connection which prevents rotational movement therebetween.

* * * * *